United States Patent [19]

Vandermeyden

[11] Patent Number: 4,834,284

[45] Date of Patent: May 30, 1989

[54] HOT WATER CONTROL

[75] Inventor: Tom R. Vandermeyden, Lakewood, Calif.

[73] Assignee: Fluidmaster, Inc., Anaheim, Calif.

[21] Appl. No.: 214,600

[22] Filed: Jun. 29, 1988

[51] Int. Cl.[4] ..... F23N 1/08

[52] U.S. Cl. ..... 236/20 R; 126/374; 219/334; 236/46 R

[58] Field of Search ..... 236/20 R, 46 R, 46 A; 126/351, 374; 219/330, 328, 334, 492

[56] References Cited

U.S. PATENT DOCUMENTS

| | | | |
|---|---|---|---|
| 4,508,261 | 4/1985 | Blank | 236/20 R |
| 4,620,667 | 11/1986 | Vandermeyden et al. | 236/20 R |
| 4,759,497 | 7/1988 | Cook | 236/20 R |

*Primary Examiner*—Edward G. Favors

*Attorney, Agent, or Firm*—Freilich, Hornbaker, Rosen & Fernandez

[57] ABSTRACT

A system is described for use with a hot water supply for hotels, apartment buildings and similar multi-unit structures, which controls the temperature $T_1$ of water at the outlet of a water tank to make it close to a desired temperature DTEMP that is low during times of low demand to save energy and which is high at times of high demand to assure adequate hot water at all times. The desired temperature at the tank outlet, DTEMP, is adjusted according to the sensed demand for hot water during an immediately preceding period of given duration, such as 45 minutes. The circuitry is used in parallel with an existing Aquastat on a commercial tank type water heater.

11 Claims, 3 Drawing Sheets

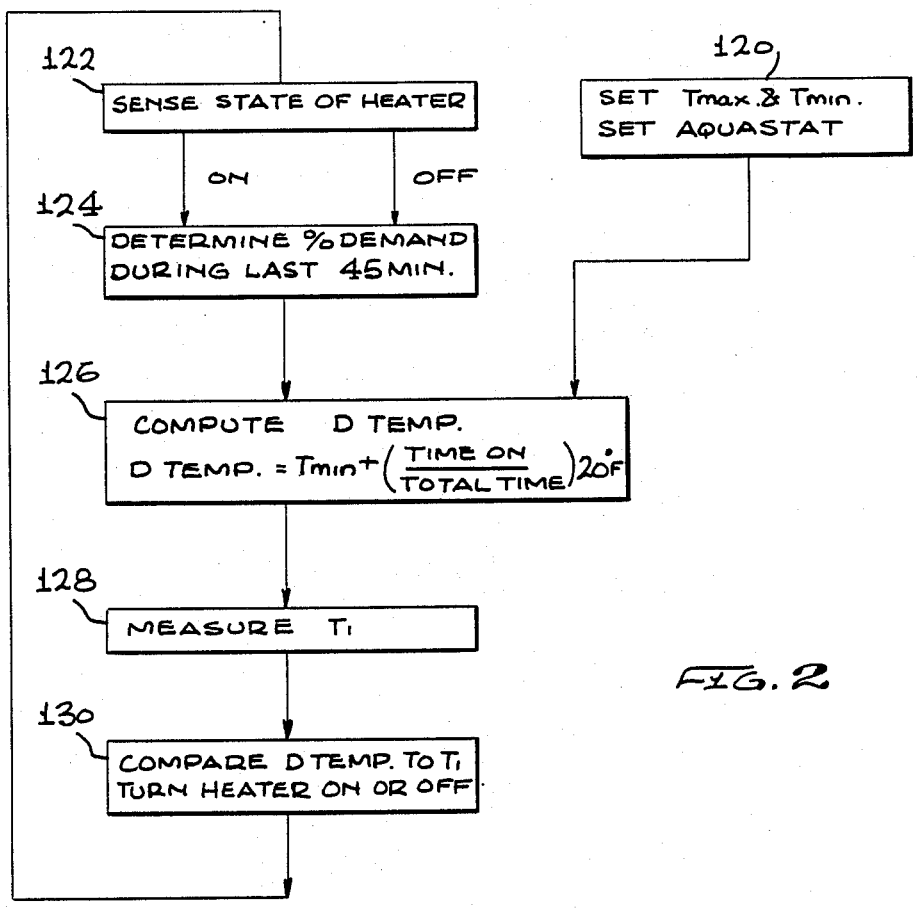
FIG. 2
FIG. 4
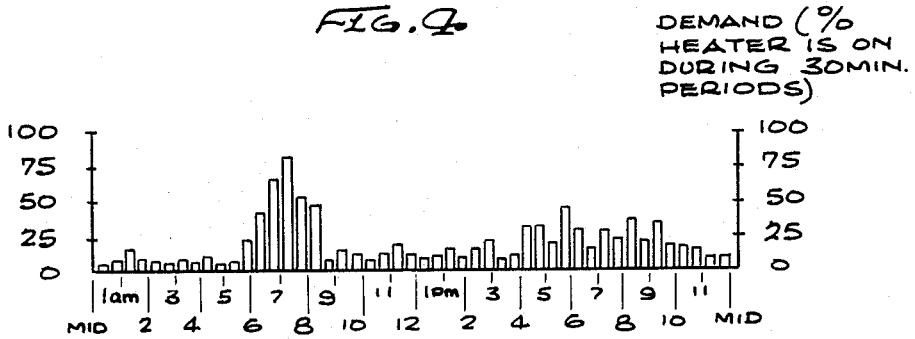

HOT WATER CONTROL

BACKGROUND OF THE INVENTION

Water may be supplied to multi-unit structures such as hotels and apartment buildings, using a recirculating system supplied with water from a commercial tank-type water heater. Such a water heater typically includes an Aquastat that has a sensor that senses water temperature within the tank and a control that can be set to a particular minimum water temperature. The control may be set to 140° F. to assure all units receive water at a sufficient temperature such as 110° F. even during heaviest demand. During times of very low demand, a tank temperature such as 115° F. would be sufficient to supply adequate hot water, while avoiding the large heat losses to the environment that occur during recirculating of very hot water.

An earlier U.S. Pat. No. 4,522,333, owned by assignee of the present application, describes an improved system where the temperature $T_1$ at the water tank outlet is adjusted according to anticipated demand for water. In that system anticipated demand is derived from the history of water usage for that structure, based on demand for water one week earlier, on the same day and at the same time. While such a system can save considerable amounts of heat, a practical system for keeping track of usage during many week-ago periods requires fairly complicated digital circuitry. A hot water heating system which reduced heat loss caused by high water tank temperatures during extended periods of low demand, while providing adequate hot water during periods of high demand, using relatively simple, low cost, and reliable circuitry, would be of considerable value.

SUMMARY OF THE INVENTION

In accordance with one embodiment of the present invention, a water heater system is provided, which can be used in conjunction with a commercial tank-type water heater, for controlling water tank temperature in accordance with demand, which is of relatively simple and reliable design. The system includes means for setting maximum and minimum water tank temperatures, a memory coupled to the heater of the water tank assembly for storing a quantity representing the proportion of time the heater was on during an immediately preceding period, and circuitry calculating a desired temperature DTEMP according to the set temperatures and the proportion of time the heater was on during the immediately preceding period. In one system, DTEMP is set to equal the minimum set temperature plus the difference between typical maximum and minimum set temperatures times the proportion of time the heater was on in the immediately preceding period.

The novel features of the invention are set forth with particularity in the appended claims. The invention will be best understood from the following description when read in conjunction with the accompanying drawings.

BRIEF DESCRIPTION OF THE DRAWINGS

FIG. 2 is a flow chart showing the overall sequence of operation of the system of FIG. 1.

FIG. 4 is a chart showing typical variation in demand for hot water during a 24 hour period.

DESCRIPTION OF THE PREFERRED EMBODIMENT

Figure 1:
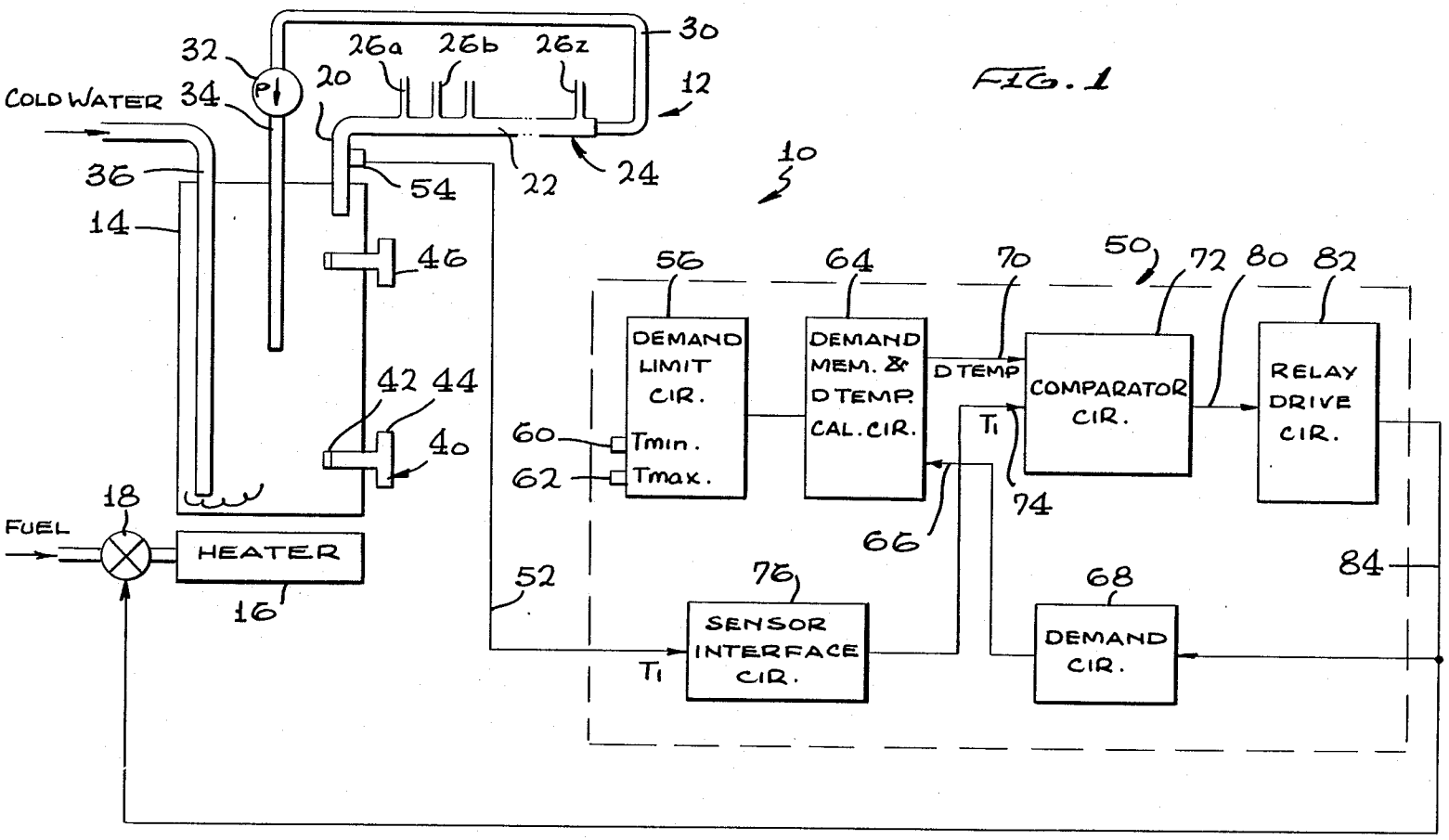
FIG. 1 is a schematic and block diagram view of a hot water system constructed in accordance with one embodiment of the present invention.

FIG. 1 illustrates a hot water heating system 10 of the present invention, which is used with a typical hot water heating installation 12 for a multi-unit building such as a hotel. The system includes a hot water storage tank 14 whose water is heated by a heater 16 that receives gaseous fuel through a valve 18. Water exits the tank through a tank outlet 20 and moves along a supply portion 22 of a pipeline 24 past numerous water consumption stations labelled **26*a*–26*z*. After passing by the last consumption station or unit 26*z*, the water moves along a return portion 30 of the pipeline through a recirculating pump 32 to a recirculating inlet 34 of the water tank. As water is drawn off, cold water is supplied at a cold water inlet 36**.

The installation includes an Aquastat 40 that includes a sensor 42 lying within the water tank, and a control 44 which can be manually set to any temperature within a desired range such as 100° F. to 180° F. The Aquastat is coupled to the gas value 18 to turn the heater on and off as the temperature of water in the tank lies below or above the preset temperature, with perhaps a 1° F. hysteresis so the temperature must fall at least 1° F. below the set temperature before the heater is turned on. The sensor 42 senses the temperature of water lying in the lower half or middle of the tank. If there is a sudden increase in demand, so a lot of cold water suddenly enters the tank, the sensor 42 detects this and quickly turns on the heater to heat that water, even though water near the top of the tank may not have cooled. A high limit switch 46 of the installation can be set to a high temperature such as 160° F. to 180° F. to turn off the heater if the temperature of water near the top of the tank reaches the set limit, to act as a safety switch.

There are two prime requirements in operating the system. The primary requirement is that all units be supplied with water of sufficiently high temperature, such as at least 110° F., at whatever consumption rate that occurs. A second consideration is that the amount of fuel used by the heater 16 be a minimum, while meeting the first requirement. For most hot water uses, such as for showers and baths, the user attempts to draw whatever amount of hot water is required to obtain a comfortable temperature when mixed with cold water. If the hot water supplied to the station is at a high temperature such as 140° F., a smaller volume of hot water will be drawn off than if a minimal temperature such as 110° F. is supplied. Thus, if a tank holds water of a high temperature such as 140° F., then it is more likely that sufficient water will be available during times of high demand, than if the tank water temperature is lower. Many older buildings have therefore maintained the water tank temperature at a constant high level such as 140° F. to meet maximum demand.

Considerable energy is lost by transfer of heat from the hot water-carrying pipeline 24 to the environment. Many hot water pipelines are poorly insulated and run along unheated portions of a building such as in the basement. While the supply portion 22 of the pipeline may be of moderate size, such as of 2-inch diameter pipe, the recirculating portion 30 may be of a small size, such as 1 inch pipe and considerable heat can be lost along it. The amount of heat loss can be minimized by minimizing the temperature of water in the pipeline 24. Of course, as mentioned above, the water temperature must always be high enough at the last consumption station, such as at least 110° F., to meet the needs of the users.

In accordance with the present invention, a control circuit 50 is provided which is used in conjunction with a typical hot water heating installation 12, to minimize energy loss while still supplying sufficient hot water, by reducing the temperature of water in the tank 14 during periods of low consumption. The control circuit 50 basically sets a desired temperature DTEMP for water in the tank and continuously varies the desired temperature according to the demand for hot water during an immediately preceding period such as about 45 minutes. It senses demand by sensing the proportion of time that the heat 16 was on during the immediately preceding period. Thus, if the heater 16 has been on 90% of the time during the past 45 minutes, this indicates that in the recent past there has been a high demand for water, and DTEMP will be set at a high temperature because of the high likelihood that the high demand will continue. On the other hand, if the heater 16 has been on only 5% if the time during the past 45 minutes, this indicates there has been a low demand and there is likely to continue to be a low demand for the immediate future, and DTEMP will be set at a low level.

The control circuit 50 has an input line 52 which receives a signal from a control circuit sensor 54 that indicates the temperature $T_1$ of water at the tank outlet 20. Such a sensor can be merely strapped to the pipeline leading from the tank. The control circuit includes a demand limit circuit 56 which has manual controls 60, 62 that can be set to determine the limits of tank water temperature $T_1$. In one example, the control 60 is set to a $T_{min}$ of 115° F., while the control 62 is set to a $T_{max}$ of 135° F. The circuit 56 is connected to a demand memory and DTEMP calculating circuit 64. The circuit 64 has an input from a demand circuit 68, the input on 66 representing the state of the heater 16, that is, whether the heater is on or off. The circuit 64 calculates DTEMP as a function of the proportion of time the heater has been on during an immediately preceding period, and the difference between typical settings $T_{min}$ and $T_{max}$. The circuit 64 has an output on line 70 representing the desired temperature DTEMP. The output on line 70 is delivered to a comparator circuit 72 which compares DTEMP with a signal on a line 74 representing $T_1$, which is the temperature of water in the water tank, and specifically at the outlet of the water tank. Signals on line 74 are received from a sensor interface circuit 76 which is coupled to the sensor 54 at the water tank outlet. The comparator circuit 72 senses whether the actual water tank temperature $T_1$ is or is not less than DTEMP. The circuit 72 delivers a signal on line 80 that controls a relay circuit 82 to turn on the heater if $T_1$ is less than DTEMP. The output 84 of the relay circuit is delivered to the gas valve 18 that controls the delivery of gas to the heater 16 to turn it on or off (the heater 16 has a pilot light and turns on only when large quantities of gas are received through the valve 18).

Figure 3:
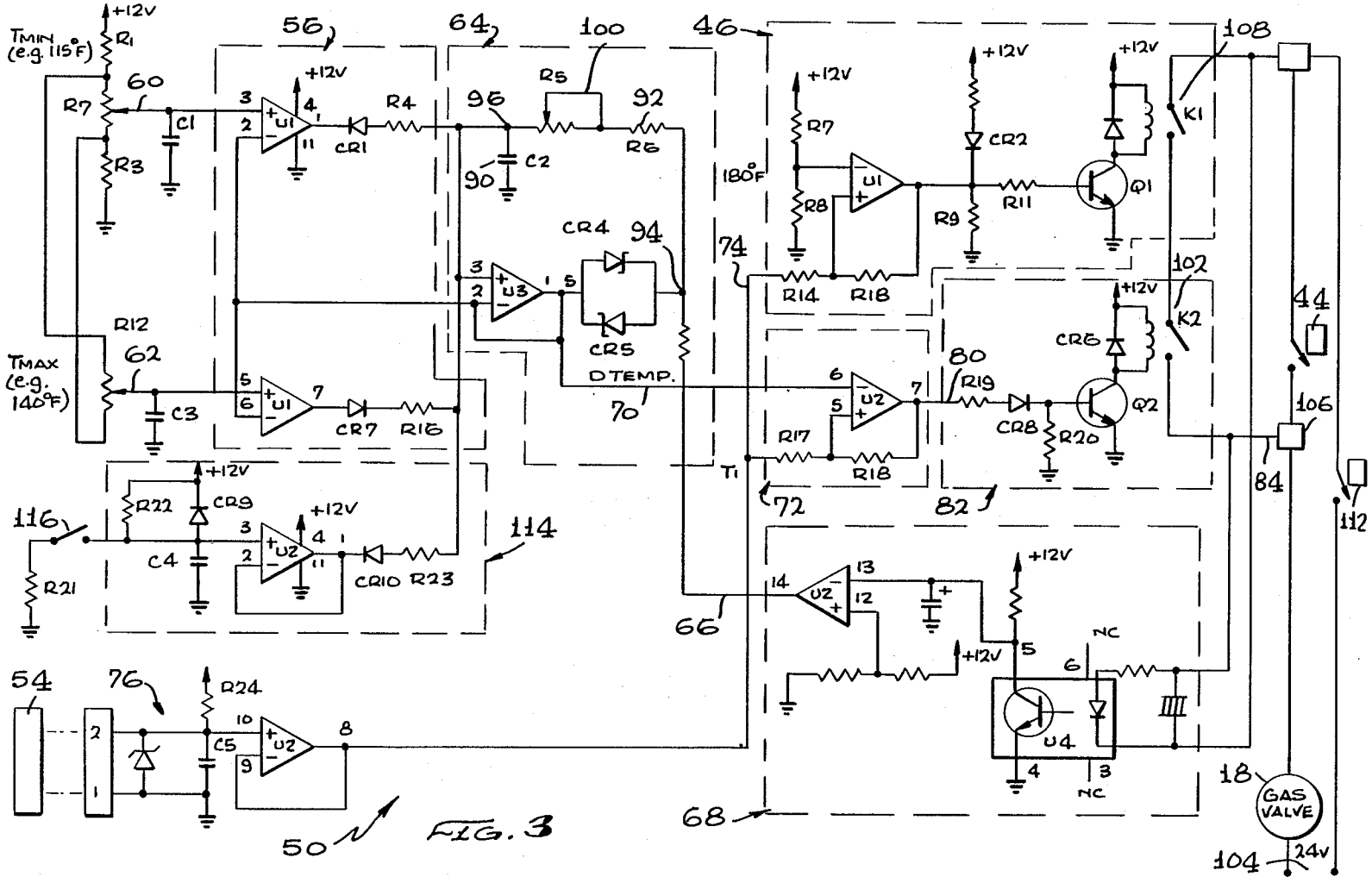
FIG. 3 is a more detailed schematic diagram of the circuitry of the system of FIG. 1.

FIG. 3 is a schematic diagram of the control circuit 50, and also showing how the control circuit is connected in conjunction with the existing Aquastat on the water tank installation. The manual controls 60, 62 for setting $T_{min}$ and $T_{max}$ are potentiometers. Their outputs are delivered to operational amplifiers labelled U1 in the demand limit circuit 56. The demand memory and DTEMP calculator circuit 64 includes a capacitor 90 which is linearly charged according to whether the heater is off or on. The voltage at point 94 of the circuit equals the voltage at the side 96 of the capacitor plus or minus 0.7 volts. This 0.7 volts passes through a 47K ohms resistor 92 (assuming a rheostat 100 is at substantially 0 ohms) so the current going to or from the capacitor 90 is always about 15 microampere. Accordingly, the voltage across the capacitor 90 is a linear ramp voltage which increases or decreases linearly according to the state of the heater. For the size of capacitor 90 that is used, it requires about 45 minutes of current in one direction to change the voltage across the capacitor to vary the signal on line 70 representing DTEMP by 20°. Applicant has found that in Southern California, typical satisfactory settings for $T_{max}$ and $T_{min}$ are 135° F. and 115° F., with the difference between them being 20° F. The circuit was designed so DTEMP can vary from $T_{min}$ to $T_{max}$ in 45 minutes, the therefore can vary by 20° F. in 45 minutes. In colder parts of the country and/or poorly insulated pipe systems, a $T_{max}$ of 140° F. or 145° F. might be expected, so DTEMP might then vary by 30° F. in 45 minutes.

The voltage across the capacitor 90 is one input to an operational amplifier of the circuit 64 labelled U3, the other input to the operational amplifier being a voltage dependent upon the settings of $T_{min}$ and $T_{max}$. The output on line 70 representing DTEMP is delivered to the comparator circuit 72 which also receives a signal on line 74 representing $T_1$. Whenever DTEMP is greater than $T_1$, the comparator circuit 72 delivers an output on its line 80 to the relay driving circuit 82 to cause it to close a relay 102. When relay 102 is closed, current from a 24-volt source 104 flows through a terminal 106 and the relay 102 to open the gas valve 18 and cause the heater to be turned on. The demand sensor circuit 68 senses current flow to the gas valve to deliver a corresponding signal on its output 66.

FIG. 3 includes a circuit 46 representing the high limit switch which is already installed in the water tank. This high limit switch includes a relay 108 which is opened whenever the sensed water temperature exceeds a predetermined limit such as 180° F. The relay switch 102 of the present invention is connected in series with the relay switch 108 of the high limit switch circuit, so that if either one is open the gas valuve will not be open unless the built-in Aquastat 40 is closed. The Aquastat 40 that is built into the water heater, is connected in parallel with the relay switch 102 of the present control circuit 50. Where applicant might set $T_{min}$ to be 115° F., he would set the Aquastat to turn on at a temperature such as 110° F. The Aquastat would turn on under conditions where the demand has previously been very low so the temperature at the water tank outlet 20 (FIG. 1) is low such as about 115° F. If there is a sudden high demand, considerable cold water will flow into the tank through the inlet 36, and the temperature of the water near the bottom of the tank will fall below 110° F., even though the temperature at the tank outlet 20 is still slightly above 115° F. The Aquastat 40, whose sensor 42 senses cold water near the bottom of the tank, will immediately turn on the heater. In this way, there is less delay in turning on the heater in such a situation where the water tank temperature is relatively low and demand suddenly increases. Applicant prefers to add an additional high limit switch 112 (FIG. 3) which opens the circuit to the gas valve in the event that a high temperature is sensed.

The control 50 is constructed so that in the event of a power failure a reset circuit 114 resets DTEMP to equal $T_{max}$, such as 135° F. This assures that efforts are taken to provide sufficient water to meet demand, immediately after a power failure, in case the power failure ended at a time of high demand. A reset switch 116 can be operated at any given time to reset DTEMP to its maximum value. The particular sensor interface circuit 76 is designed for use with a sensor 54 of the termister type. As a result of this circuitry, the voltage at the high end 96 of the capacitor 90 decreases when the heater is on and increases when the heater is off. A semiconductor temperature sensor can be used instead, to have the voltage across capacitor 90 increase when the heater is on.

To set up the system, the $T_{min}$ and $T_{max}$ are set to provide only slightly more than necessary water under the extremes of demand. Typical settings are 135° F. for $T_{max}$ and 115° F. for $T_{min}$. The built-in Aquastat 40 is set to a temperature slighly below $T_{min}$, such as 110° F. When the circuit is first turned on, DTEMP is set to equal $T_{max}$, e.g. 135° F., as though a demand during the immediately preceding period of about 45 minutes was 100% (i.e. the heater was on 100% of the time). Assuming demand is not near maximum, the heater will be on only a small proportion of the time to maintain DTEMP at 135° F. The control circuit senses that the heater is on a small proportion of the time and continually reduces DTEMP to a level consistent with demand during an immediately preceding period such as 45 minutes. After awhile of operation, the circuit generates a quantity DTEMP approximate as given by the following equation:

$$\text{DTEMP} = T_{min} + \text{DEMAND (20° F.); but } T_{min} \leqq \text{DTEMP} \leqq T_{max} \qquad \text{Eq. 1}$$

where DEMAND equals the proportion of time the heater was on during an immediately preceding period such as 45 minutes, $T_{max}$ is the maximum temperature setting at the control 62, and $T_{min}$ is the minimum temperature setting at control 60. At any given instant, the amount by which DTEMP exceeds $T_{min}$ depends upon the proportion of time the heater was on during the immediately preceding period such as 45 minutes. In one example, where $T_{max}$ is 135° F., $T_{min}$ is 115° F., and the heater has been on a total of 15 minutes during the immediately preceding period of 45 minutes (so DEMAND equals 33.3%), DTEMP will equal 121.7° F. A mentioned above, the Aquastat can turn on the heater under circumstances where the temperature of water in the tank is near $T_{min}$ and there is a sudden demand leading to a large inflow of cold water to the tank.

FIG. 2 is a flow diagram showing operation of the system. A first step at 120 is to set $T_{max}$ and $T_{min}$, and also to set the Aquastat. The next step 122 is to sense the state of the heater, whether on or off. A next step 124 is to determine the percent demand during the last immediately preceding period such as 45 minutes, which is accomplished by determining the voltage across capacitor 90 as a result of linearly increasing and decreasing its voltage according to the state of the heater. The next step 126 is to compute DTEMP, according to Equation 1, which is accomplished by the operational amplifier in the circuit 64. A next step 128 is to measure $T_1$ which is the actual temperature of water at the tank outlet. A next step is to compare DTEMP to $T_1$, and to turn the heater on or off according to whether DTEMP is respectively greater or less than $T_1$. Steps 122–130 are repeated continuously in the analog circuit of FIG. 3.

It would be possible to contruct the control circuit 50 with digital components. However, digital components are much more susceptible to radio frequency interference and result in greater cost than the analog circuit of FIG. 3. The capacitor 90 is preferably of the double layer capacitor type, which can hold a charge with leakage being insignificant for an extended period of time such as 45 minutes. Such a simple memory can be used where the period during which the proportion of demand is recorded is relatively recent, that is, considerably less than 1 day before the present instant. The period during which the proportion of time the heater is on is recorded, is preferably more than one minute since such a short period is comparable to the time the heater is on to overcome its hysteresis (e.g. 1° F.), and is preferably less than 2 hours since large changes in demand occur in much less than such a period. (I.e. where a capacitor voltage is used to represent DTEMP, as in FIG. 3, DTEMP can change by 20° F. in a period of less than 2 hours when demand continues at a very high level such as 100%.) FIG. 4 illustrates a typical variation in demand during a week day, showing demand that is very low from about 11 pm to 5:30 am, and that is large from 6 am to 8:30 am. Demand is low from 8:30 am to 4 pm, is moderate from 4 pm to 10 pm, and then becomes low or very low.

The circuitry is constructed to charge and discharge the capacitor through a constant current source, which results in changes in demand having the same effect on the record of demand during the immediately preceding period, regardless of the voltage across the capacitor (i.e. regardless of the level of DTEMP). Since the capacitor voltage never remains constant, but is always either increasing or decreasing, the voltage across it represents demand during an immediately preceding period whose beginning and ending times continually advance. The connection of the control circuit in parallel with the existing Aquastat, results in conserving fuel during normal operation, and yet permits very rapid response if there is a sudden increase in demand when the tank temperature is low, to assure an adequate hot water supply in such a situation. The system provides a relatively low cost control that minimizes heat losses during extended periods of low demand and even during periods of moderate demand, while assuring adequate hot water substantially all the time.

Although particular embodiments of the invention have been described and illustrated herein, it is recognized that modifications and variations may readily occur to those skilled in the art and consequently it is intended to cover such modifications and equivalents.

What is claimed is:

1. In a hot water heating system which includes a water tank having an inlet for receiving cold water and an outlet for delivering hot water, and a heater which can be turned to on and off states to heat and not heat water in said tank, the improvement comprising:

a first circuit which includes a sensor that senses the water tank temperature, said first circuit constructed to generate a signal representing said tank temperature $T_1$;

a second circuit which senses the state of said heater and generates a signal representing the state of said heater;

a third circuit having a portion settable to a minimum tank water temperature $T_{min}$, a memory circuit portion coupled to said second circuit and storing a quantity substantially representing the proportion of time during an immediately preceding period of time that said heater was on, and a portion that generates a signal representing a desired temperature DTEMP substantially equal to said minimum temperature $T_{min}$ plus a quantity multiplied by the proportion of time during said preceding period that said water heater was on;

a fourth circuit which compares said signal representing said tank temperature $T_1$ to said signal representing DTEMP, and which urges said heater to an on state when DTEMP is above $T_1$.

2. The improvement described in claim 1 wherein:

said memory circuit portion includes a memory which stores said quantity representing the proportion of time said heater was on, and means coupled to said second circuit for repeatedly increasing said quantity in said memory when said heater is in one of said states and for repeatedly decreasing said quantity in said memory when said heater is in the other one of said states.

3. The improvement described in claim 1 wherein:

said memory includes a capacitor and means for flowing a constant current in opposite directions to and from said capacitor to respectively increase and decrease the voltage linearly across said capacitor.

4. The improvement described in claim 1 wherein:

said sensor of said first circuit senses the temperature of water substantially at said outlet of the water tank;

said system includes an Aquastat which has a sensor that detects the temperature of water within said water tank and a temperature setting control coupled to said heater to turn on said heater when the sensed water temperature is below the temperature setting;

said Aquastat is connected in parallel with said fourth circuit, so said heater is turned on when either said fourth circuit or said Aquastat urges said heater to an on state.

5. The improvement described in claim 1 wherein:

said immediately preceding period of time has a duration of a plurality of minutes but no more than two hours.

6. In a hot water heating system which includes a water tank having an inlet for receiving cold water and an outlet for delivering hot water, a heater which can be turned to one and off states to heat and not heat water in said tank, and an Aquastat which is coupled to said tank and which has a settable temperature and that urges said heater on and not on when the tank water temperature is respectively substantially below and at the set temperature, the improvement comprising:

a control circuit having means for setting a maximum temperature $T_{max}$ and a minimum temperature $T_{min}$, said control circuit being responsive to the percent of time said heater has been on during an immediately preceding time period for generating a signal representing a desired temperature DTEMP between said temperatures $T_{max}$ and $T_{min}$ which lies progressively closer to $T_{max}$ and $T_{min}$ as the percent of time said heater was on during said period is respectively greater and smaller, said control circuit including means for sensing the temperature $T_1$ of water at said water tank and for urging said heater on and not on when DTEMP is respectively less than and not less than $T_1$;

said control circuit and Aquastat being connected in parallel to said heater, so each individually turns on said heater, and so only when both are off is the heater turned off.

7. The improvement described in claim 6 wherein:

said control circuit is constructed to generate a signal DTEMP equal to $T_{min}$ plus a preset temperature change multiplied by a quantity substantially equal to the percent of time said heater was on during said immediately preceding period;

said preceding period being no more than 2 hours prior to the time said signal representing DTEMP was generated, and said preset temperature change being about 20° F.

8. The improvement described in claim 6 wherein:

said control circuit includes a capacitor whose voltage represents DTEMP, and means for flowing a constant current in opposite directions to and from said capacitor to respectively increase and decrease the voltage linearly across said capacitor when said heater is respectively in first and second of said states, said capacitor and current being chosen so the voltage across the capacitor changes sufficiently to represent a change in DTEMP of about 20° F. in a period of a plurality to minutes but less than 2 hours when the heater is constantly in one of said states.

9. A method for controlling a water tank heater of a hot water heating system comprising:

setting maximum and minimum tank water temperatures;

establishing a desired water tank temperature DTEMP between said maximum and minimum temperatures;

sensing tank water temperature $T_1$;

establishing said heater in an on state when said tank water temperature $T_1$ is less than DTEMP and establishing said heater in an off state when said tank water temperature $T_1$ is substantially as high as DTEMP;

said step of establishing a desired temperature DTEMP includes sensing the proportion of time the heater was on during an immediately preceding period whose beginning and ending times repeatedly advance, and increasing and decreasing DTEMP as said proportion of time respectively increases and decreases.

10. The method described in claim 9 wherein:

said step of establishing a desired temperature DTEMP includes charging and discharging a capacitor when the heater is respectively in first and second of said states, the voltage across said capacitor representing the desired temperature DTEMP.

11. The method described in claim 10 wherein:

said step of charging and discharging a capacitor includes passing current from a constant current source to said capacitor, whereby to linearly change the capacitor voltage as a linear function of the proportion of time said heater is on and off.

* * * * *